US007415977B2

(12) United States Patent
Chen

(10) Patent No.: US 7,415,977 B2
(45) Date of Patent: Aug. 26, 2008

(54) THREE-IN-ONE HIGH-PRESSURE GAS CYLINDER MAGAZINE

(75) Inventor: I-Chun Chen, Sanchong (TW)

(73) Assignee: Speed Paintball Co., Ltd., Taipei County (TW)

( * ) Notice: Subject to any disclaimer, the term of this patent is extended or adjusted under 35 U.S.C. 154(b) by 361 days.

(21) Appl. No.: 11/196,436

(22) Filed: Aug. 4, 2005

(65) Prior Publication Data

US 2007/0028911 A1 Feb. 8, 2007

(51) Int. Cl.
*F41B 11/00* (2006.01)

(52) U.S. Cl. ..... 124/74; 124/45; 124/52

(58) Field of Classification Search ..... 124/74, 124/45, 52

See application file for complete search history.

(56) References Cited

U.S. PATENT DOCUMENTS 2,881,752 A * 4/1959 Blahnik ..... 124/75
5,906,191 A * 5/1999 Wonisch et al. ..... 124/31
6,026,797 A * 2/2000 Maeda et al. ..... 124/74
6,470,872 B1 * 10/2002 Tiberius et al. ..... 124/74
6,494,194 B2 * 12/2002 Shipachev et al. ..... 124/73
7,237,543 B2 * 7/2007 Su ..... 124/71
2004/0200466 A1 * 10/2004 Salva ..... 124/74
2006/0201491 A1 * 9/2006 Wei ..... 124/74

* cited by examiner

*Primary Examiner*—Michael J. Carone
*Assistant Examiner*—Gabriel J Klein
(74) *Attorney, Agent, or Firm*—Troxell Law Office, PLLC

(57) ABSTRACT

A three-in-one high-pressure gas cylinder magazine. A high-pressure gas cylinder is installed within a holding cavity, and held firmly using a fine tuning knob and securing cover. A spring mount and a securing seat are disposed within a pellet guide cavity defined parallel to the holding cavity. When the pellets are decreasing, the inner securing seat upwardly pushes the pellets within the pellet guide cavity and secures them within a securing ring in a ready state for propelling out a model pistol. When a gastight valve within a cylinder is full of gas, then an inner piston rod is put in a pneumatic state, and the cylinder and a slide cover are simultaneously driven backward as soon as the piston rod is driven by the gas, thereby fixing a hammer in a rear position, thus achieving simplification, automatic operating functionality, and succeeding in simulating a real pistol.

2 Claims, 10 Drawing Sheets

THREE-IN-ONE HIGH-PRESSURE GAS CYLINDER MAGAZINE

BACKGROUND OF THE INVENTION (a) Field of the Invention

The present invention relates to an improved structure for a three-in-one high-pressure gas cylinder magazine, and more particularly to a high-pressure gas cylinder that is installed within a holding cavity, and to a fine tuning knob and securing cover that are disposed at a bottom portion of the holding cavity and used to firmly hold the high-pressure gas cylinder within the holding cavity.

(b) Description of the Prior Art

The majority of model pistols adopt an internal hammer mechanism for shooting plastic pellets, while some adopt an external connected high-pressure gas cylinder that connects to the model pistol by means of a connecting tube; the high-pressure gas cylinder being used to propel plastic pellets, thereby enabling a user to experience the feeling of exhilaration that comes from shooting a pistol.

However, regardless of whether the model pistol adopts a hammer mechanism or a high-pressure gas cylinder mechanism, every time the model pistol is shot, the plastic pellet must pass through an internal structure. Moreover, when using such mechanisms, not only do they not provide a realistic simulation of real pistol shooting, but also the connecting tube and the high-pressure gas cylinder externally connected to the model pistol cause inconvenience to a user when moving.

Hence, the inventor of the present invention proposes to resolve and surmount existent technical difficulties to eliminate the aforementioned shortcomings and provide an improved structure for a three-in-one high-pressure gas cylinder magazine.

SUMMARY OF THE INVENTION

The present invention provides an improved structure for a three-in-one high-pressure gas cylinder magazine, and is characterized in that a high-pressure gas cylinder is installed within a holding cavity. Moreover, a fine tuning knob and securing cover disposed at a bottom portion of the holding cavity are used to firmly hold the high-pressure gas cylinder within the holding cavity. Furthermore, a gastight valve, a piston rod, a spring, a securing washer and a gastight plastic ring are configured within a cylinder. When the gastight valve within the cylinder is full of gas, then the piston rod within the cylinder is put in a pneumatic state, and the cylinder and a slide cover are simultaneously driven backward as soon as the piston rod is driven by the gas, thereby fixing a hammer in a rear position, and simplifying the mechanical movements involved in actuating the firing mechanism of a model pistol. Moreover, the present invention is provided with automatic operating functionality, and succeeds in simulating a real pistol.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
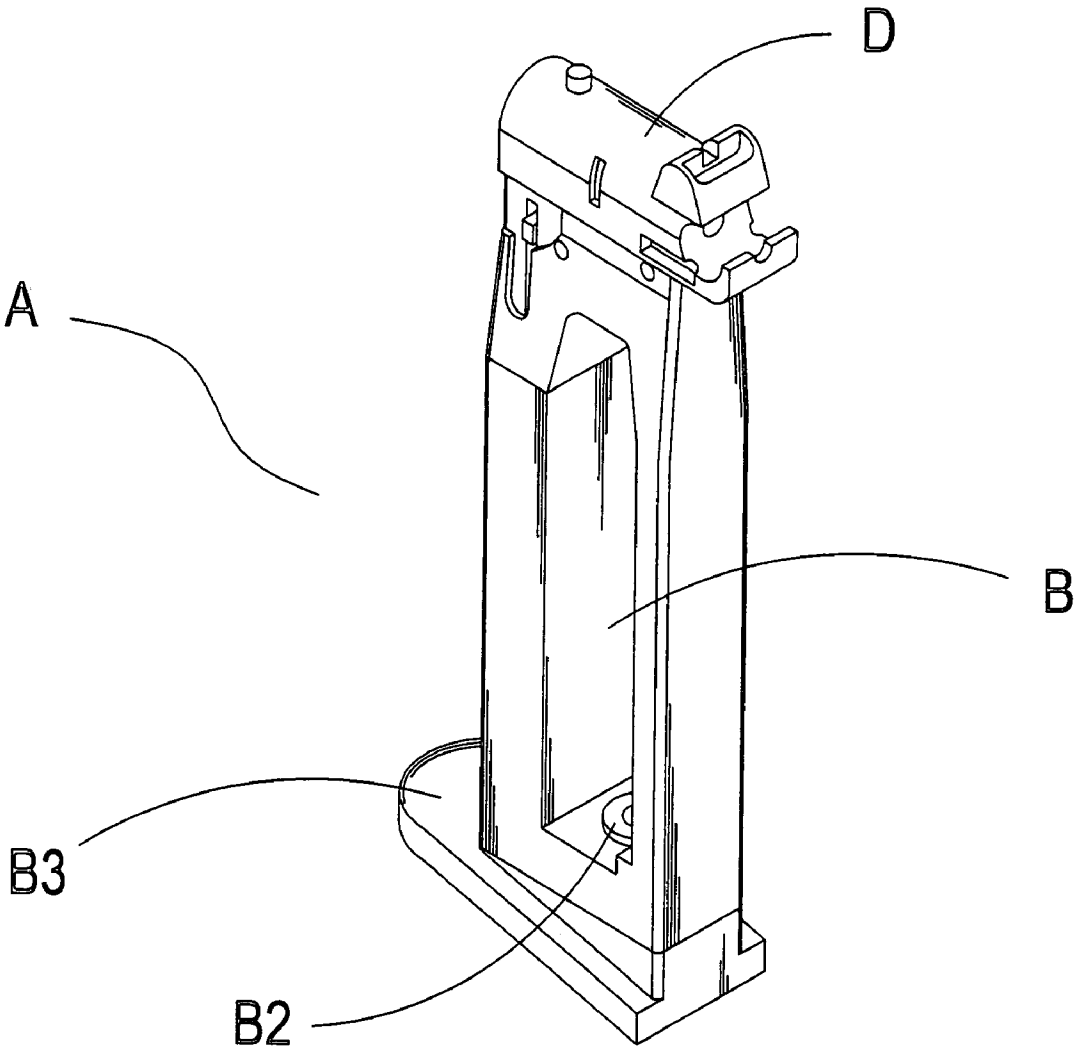
FIG. 1 shows an elevational view according to the present invention.
Figure 2:
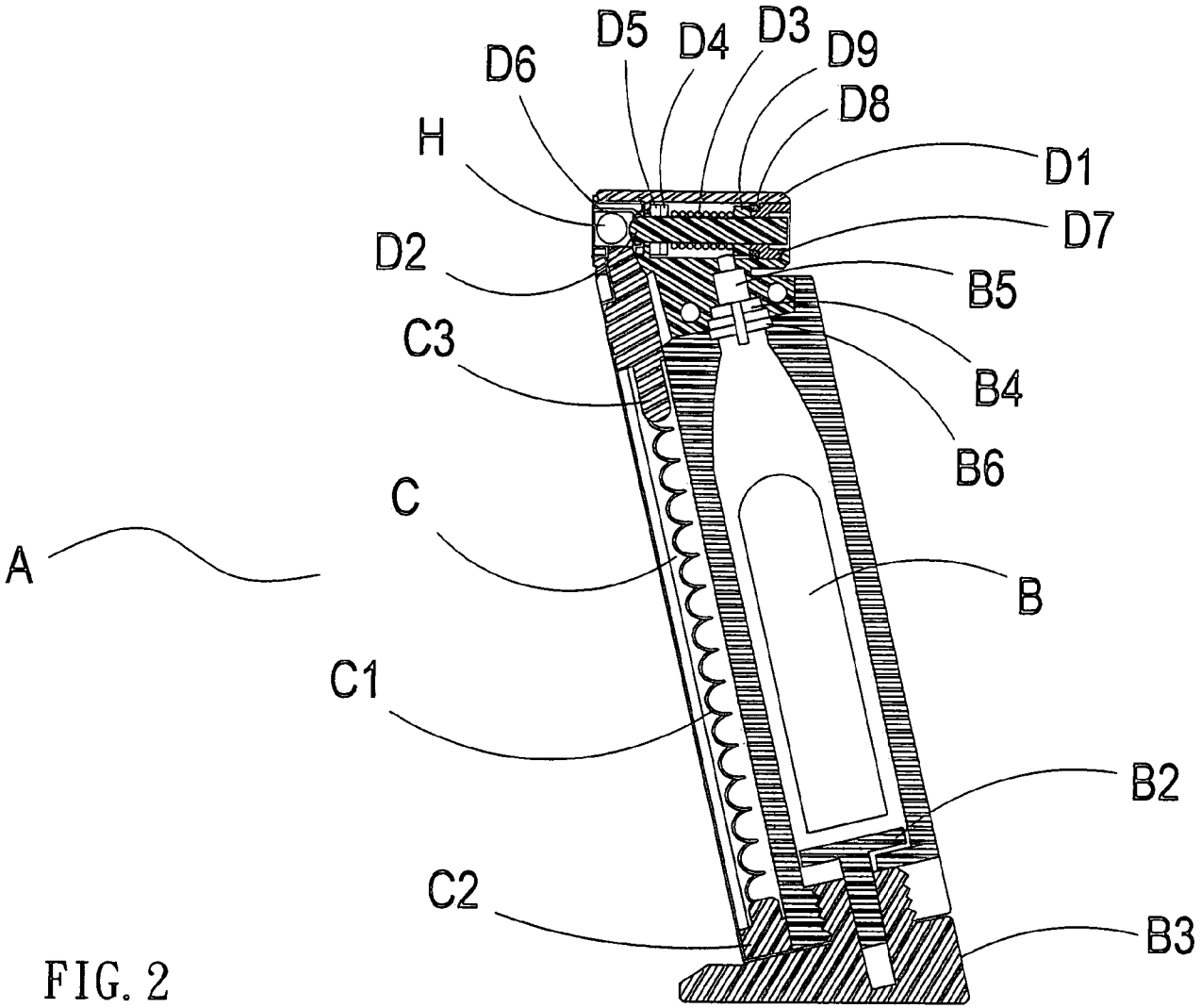
FIG. 2 shows an elevational cross-sectional view according to the present invention.
Figure 3:
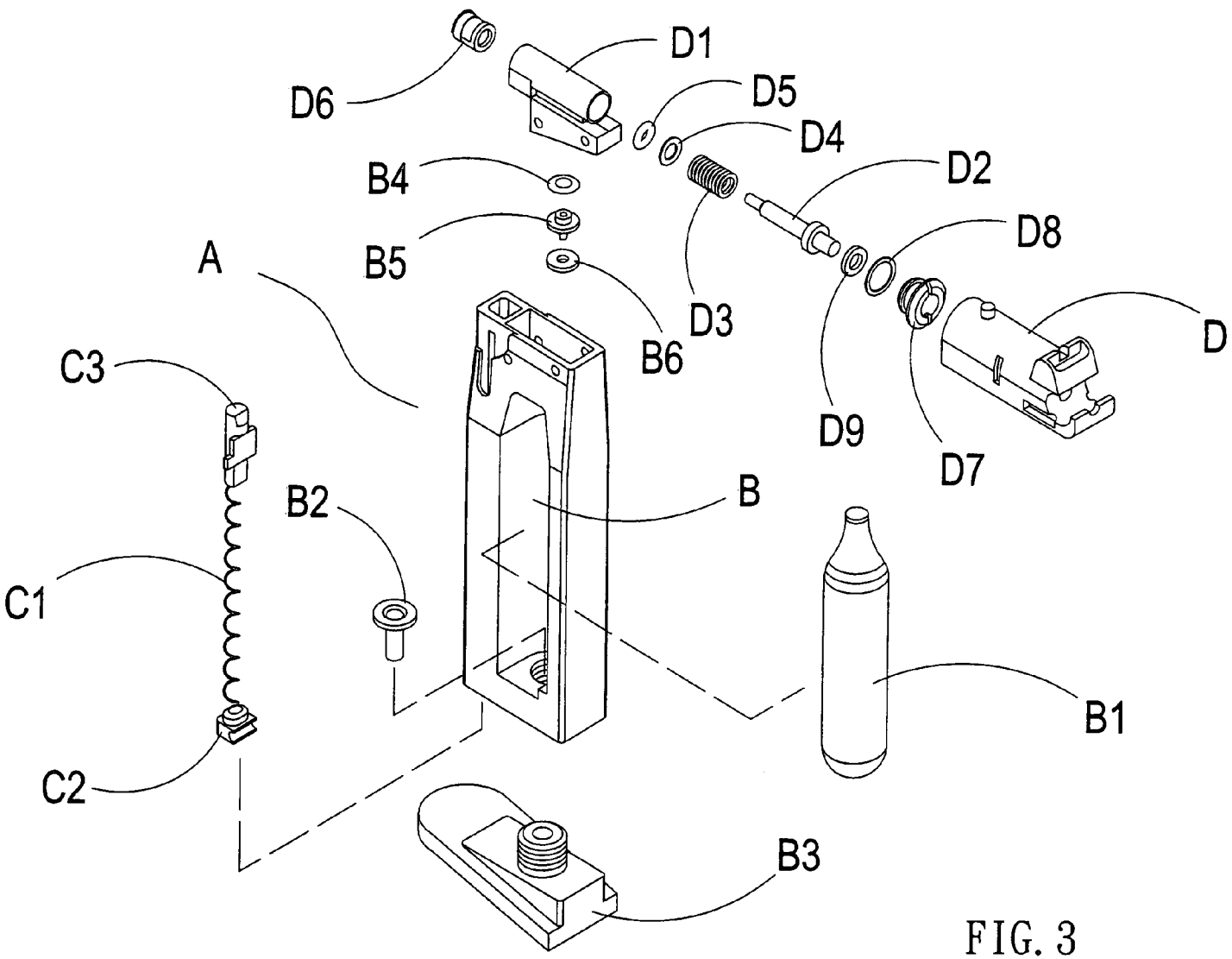
FIG. 3 shows an exploded elevational view according to the present invention.

Referring to FIGS. 1, 2 and 3, which show an improved structure for a three-in-one high-pressure gas cylinder magazine of the present invention, wherein a magazine A is structured to comprise a holding cavity B, a pellet guide cavity C and a cylinder D.

A high-pressure gas cylinder B1 is installed within the holding cavity B, a securing fine tuning knob B2 is configured at a bottom portion of the holding cavity B, and a contrarotation locking securing cover B3 further extends from and is thereby configured to the fine tuning knob B2. A gastight plastic ring B4, a gas cylinder thimble B5 and a securing washer B6 are configured to a top end of the holding cavity B, which prevent gas from leaking out of the high-pressure gas cylinder B1 when installed within the holding cavity B.

The pellet guide cavity C is parallel defined lateral to the holding cavity B, and a mount C2 connected to one end of a spring C1 and a securing seat C3 used for holding pellets H are disposed within the pellet guide cavity C. When the pellets H within the pellet guide cavity C decrease, the inner securing seat C3 upwardly pushes the pellets H within the pellet guide cavity C, which thereby puts the pellets H in a ready state for propelling out the model pistol.

A gastight valve D1, a pistol rod D2, a spring D3, a securing washer D4 and a gastight plastic ring D5 are configured within the cylinder D, which prevent gas from leaking out of the cylinder D when filled with gas. A securing ring D6 for securing the pellet H is configured on a front end of the gastight valve D1, and a collar D7 for screwing tight the gastight valve D1 is configured on a rear end of the gastight valve D1. A gastight plastic ring D8 and a securing washer D9 are configured on the collar D7.

The present invention is characterized in that the holding cavity B, the pellet guide cavity C and the cylinder D are configured within the magazine A. Moreover, when the high-pressure gas cylinder B1 is installed within the holding cavity B, the gastight valve D1 within the cylinder D is simultaneously filled with the high-pressure gas, and the piston rod D2 is put in a pneumatic state. The cylinder D and a slide cover E are simultaneously driven backward as soon as the piston rod D2 is driven by the gas, thereby fixing a hammer F to a rear position, and simplifying the mechanical movements involved in actuating the firing mechanism of a model pistol. Moreover, the present invention is provided with automatic operating functionality, and succeeds in simulating a real pistol.

Figure 4:
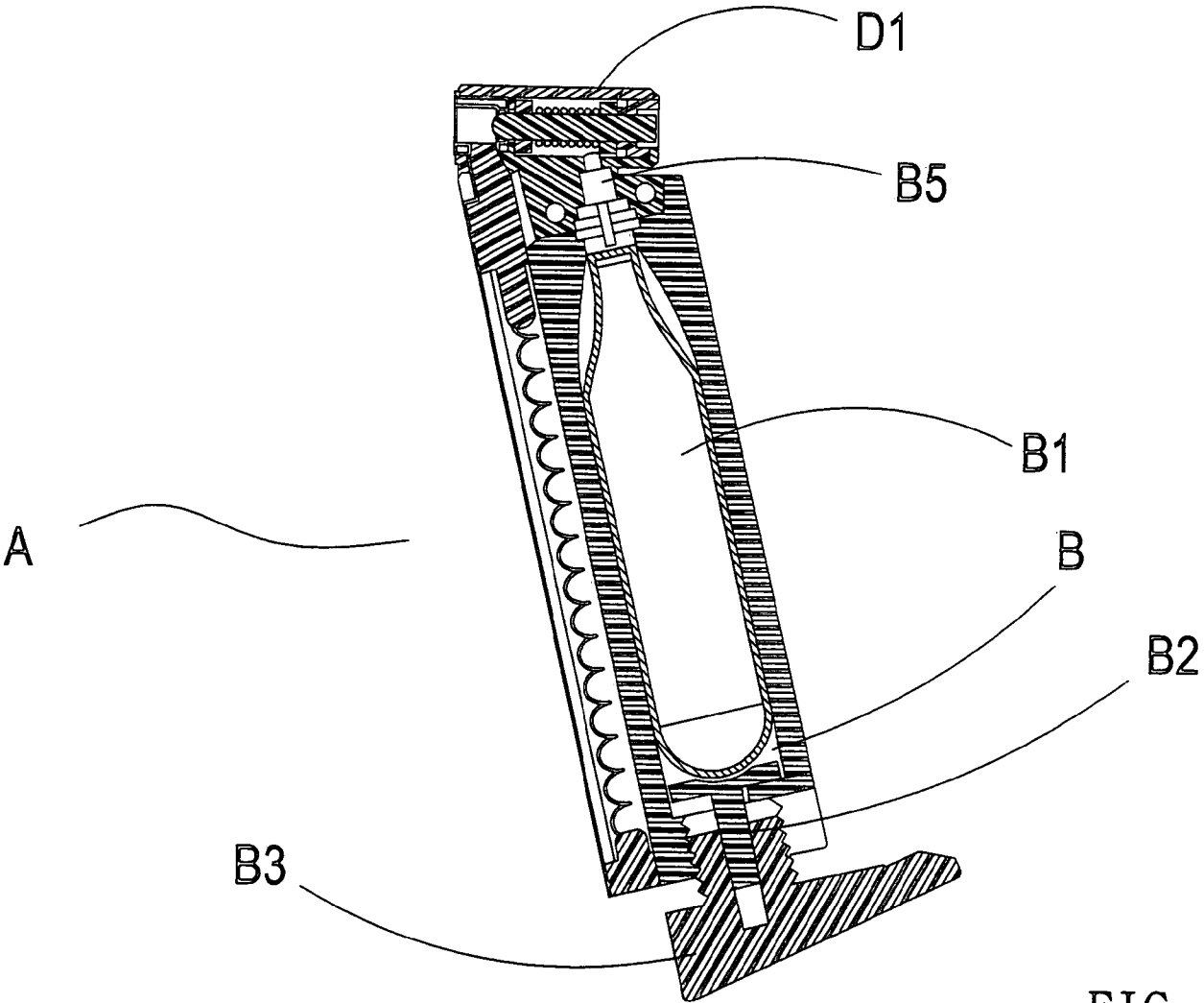
FIG. 4 shows a schematic view of the present invention in use (1).
Figure 5:
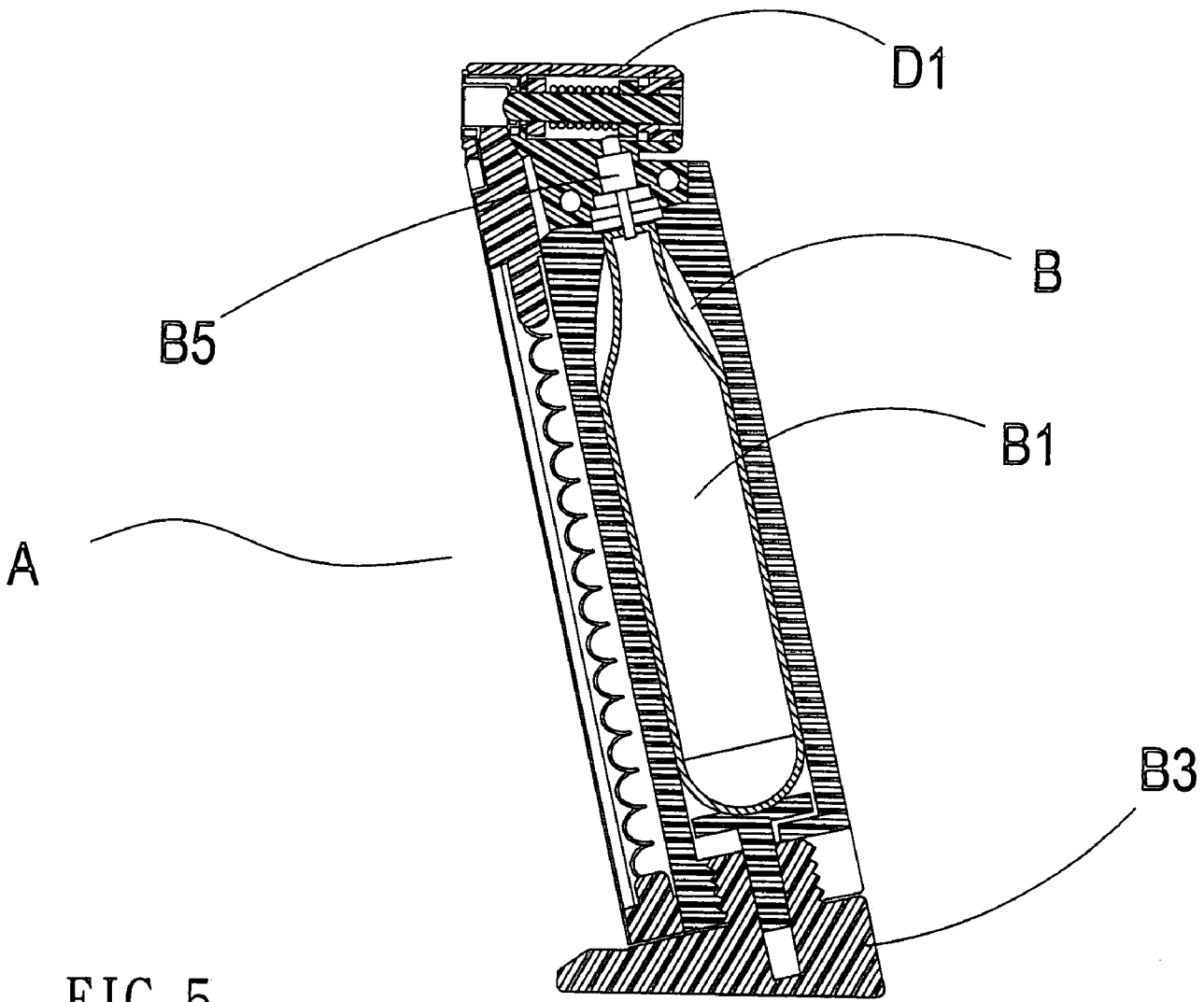
FIG. 5 shows a schematic view of the present invention in use (2).

Referring to FIGS. 4 and 5, which shows an embodiment of the present invention. When the high-pressure gas cylinder B1 is installed within the holding cavity B of the magazine A, the fine tuning knob B2 disposed within the holding cavity B is used to secure the high-pressure gas cylinder B1 within the holding cavity B.

After the high-pressure gas cylinder B1 is installed within the holding cavity B, the securing cover B3 at the bottom portion of the holding cavity B is turned in an anticlockwise direction to lock position of the high-pressure gas cylinder B1, which thereby causes the gas cylinder thimble B5 to penetrate into the high-pressure gas cylinder B1 and pressurize the gastight valve D1, which is accordingly put in a pneumatic state.

Figure 6:
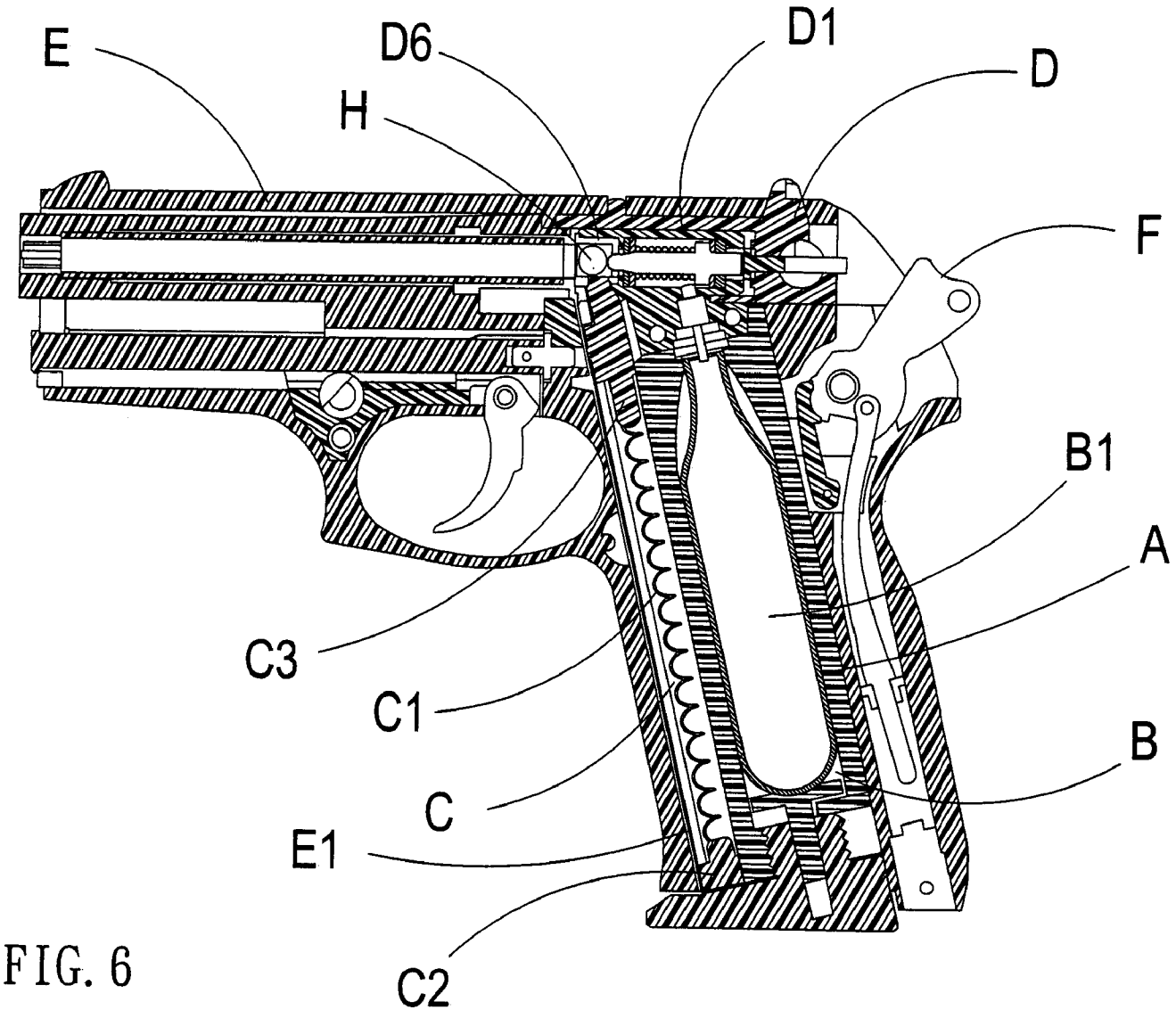
FIG. 6 shows a cross-sectional view of an embodiment according to the present invention in use (1).
Figure 7:
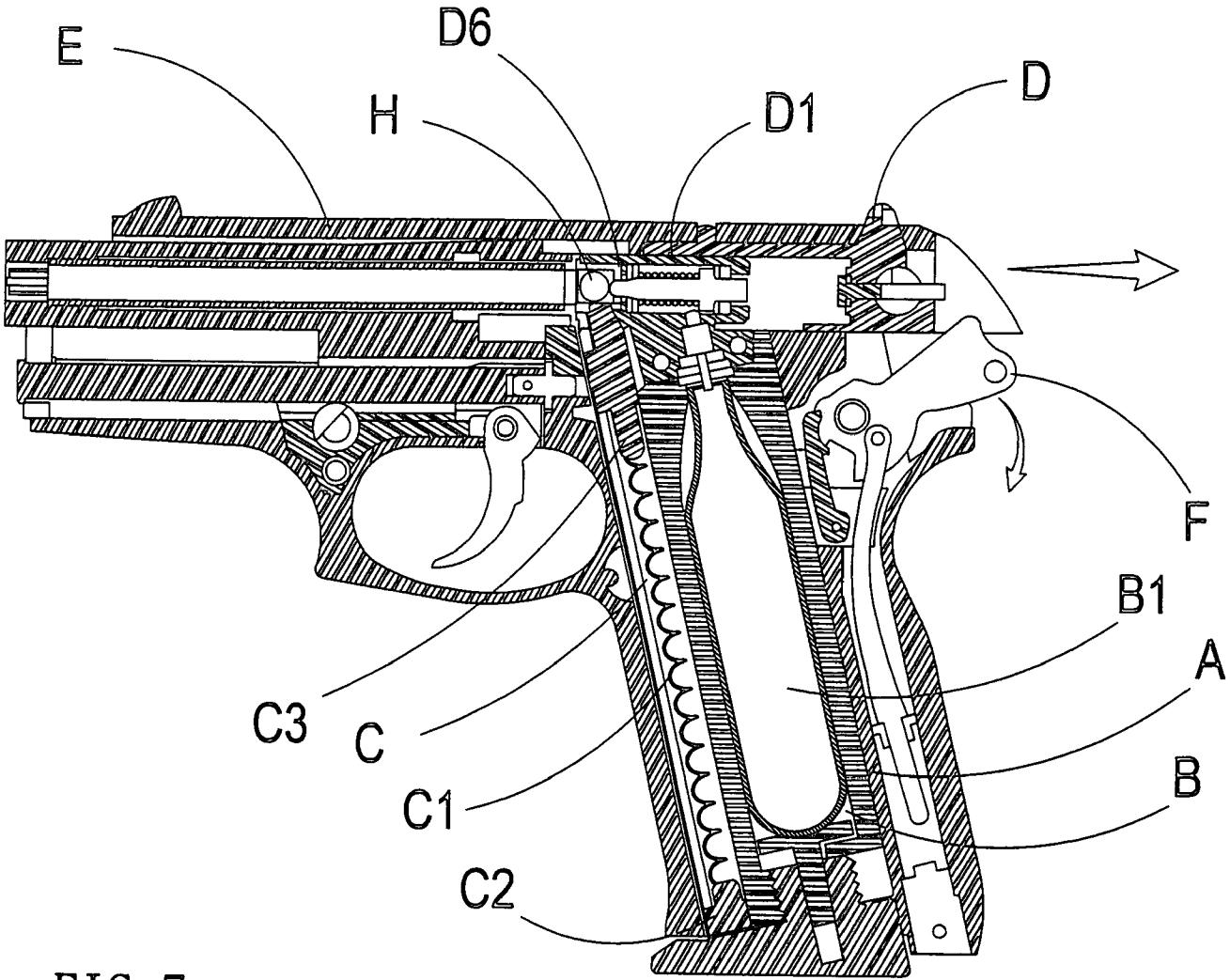
FIG. 7 shows a cross-sectional view of the embodiment according to the present invention in use (2).

Referring to FIGS. 6 and 7, after the pellets H are disposed within the pellet guide cavity C within the magazine A and the high-pressure gas cylinder B1 is installed within the holding cavity B, the magazine A is then installed within a magazine cavity E1, which thereby disposes the gastight valve D1 of the magazine A within the gas cylinder D. After the magazine A is installed within the magazine cavity E1 of the pistol handle, a backward driving movement of the slide cover E is used to simultaneously fix the hammer F to a rear position.

The mount C2 connected to the spring C1 and the securing mount C3 used for holding the pellets H are configured within the pellet guide cavity C parallel disposed lateral to the holding cavity B, and when the pellets H within the pellet guide cavity C decrease, the inner securing seat C3 upwardly pushes the pellets H within the pellet guide cavity C, and secures the pellets H within the securing ring D6 in a ready state for propelling out the model pistol.

Figure 8:
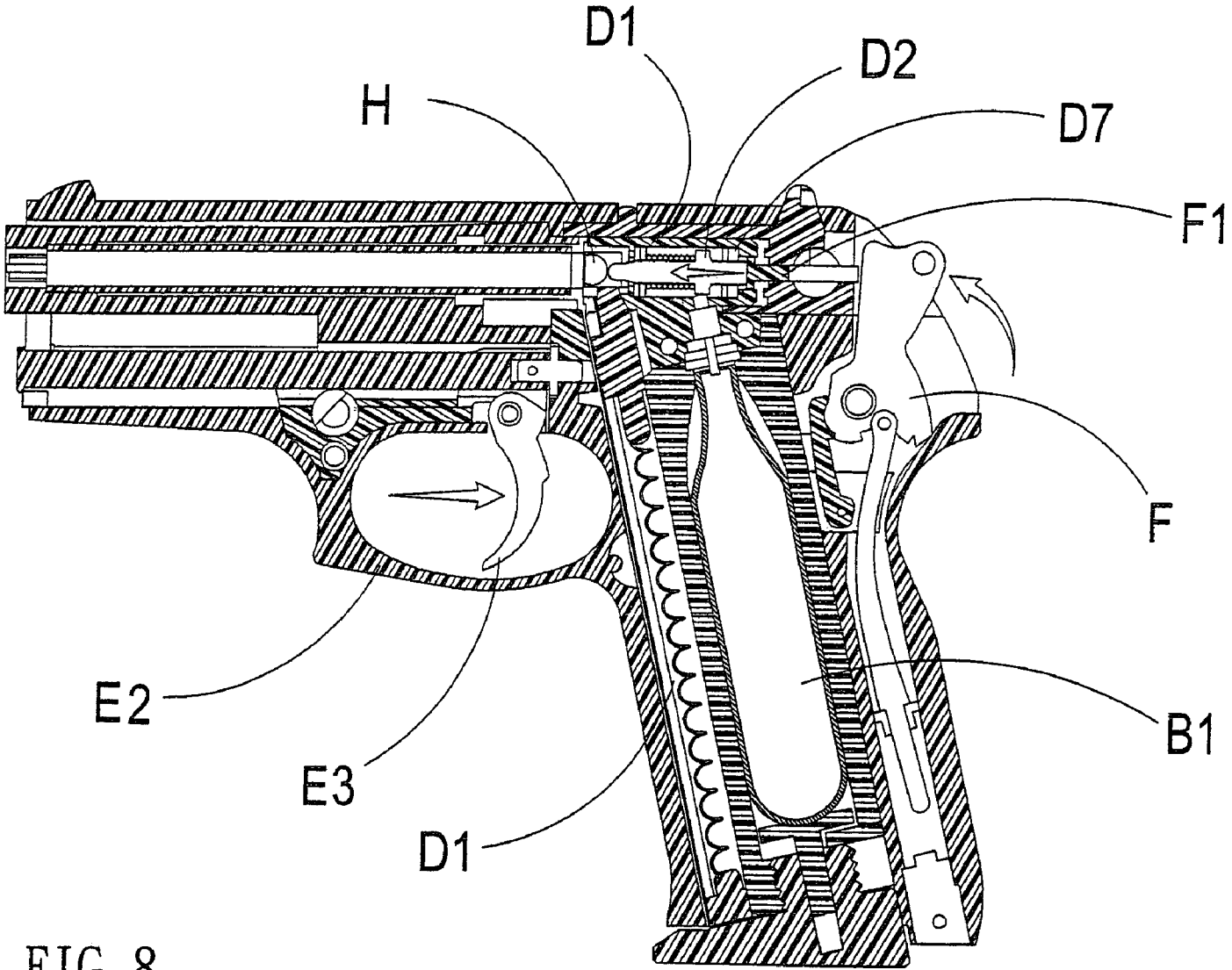
FIG. 8 shows a cross-sectional view of the embodiment according to the present invention in use (3).

Referring to FIG. 8, when the high-pressure gas within the high-pressure gas cylinder B1 fills the cylinder D and puts the piston rod D2 in a pneumatic state, and the pellets H within the pellet guide cavity C are put in a ready state for propelling out the model pistol, a trigger E3 within a trigger chamber E2 is pressed backwards, thereby causing the hammer F to hit a firing pin F1 within the gastight valve D1, which forces the piston rod D2 within the gastight valve D1 to move forward.

Figure 9:
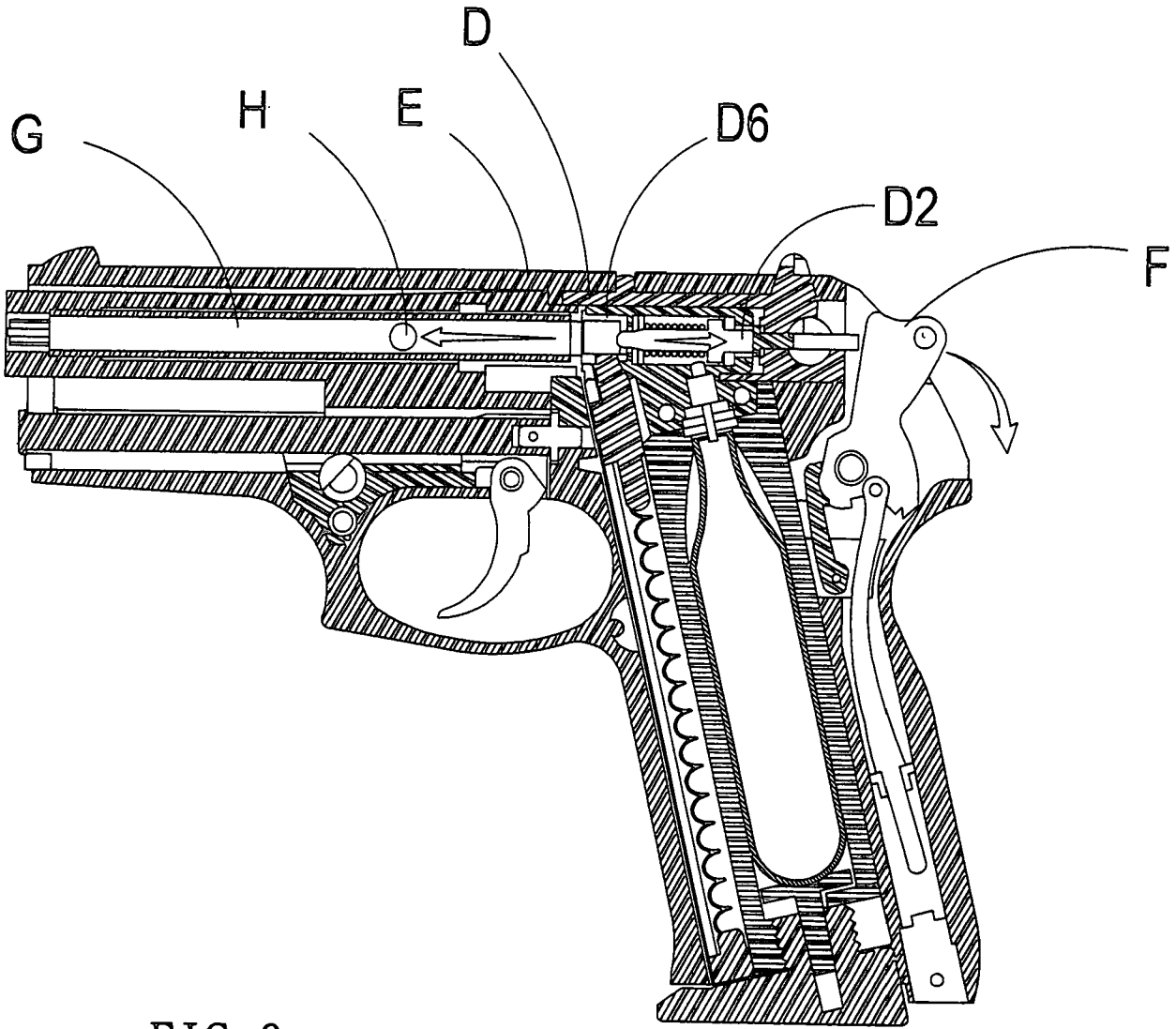
FIG. 9 shows a cross-sectional view of the embodiment according to the present invention in use (4).
Figure 10:
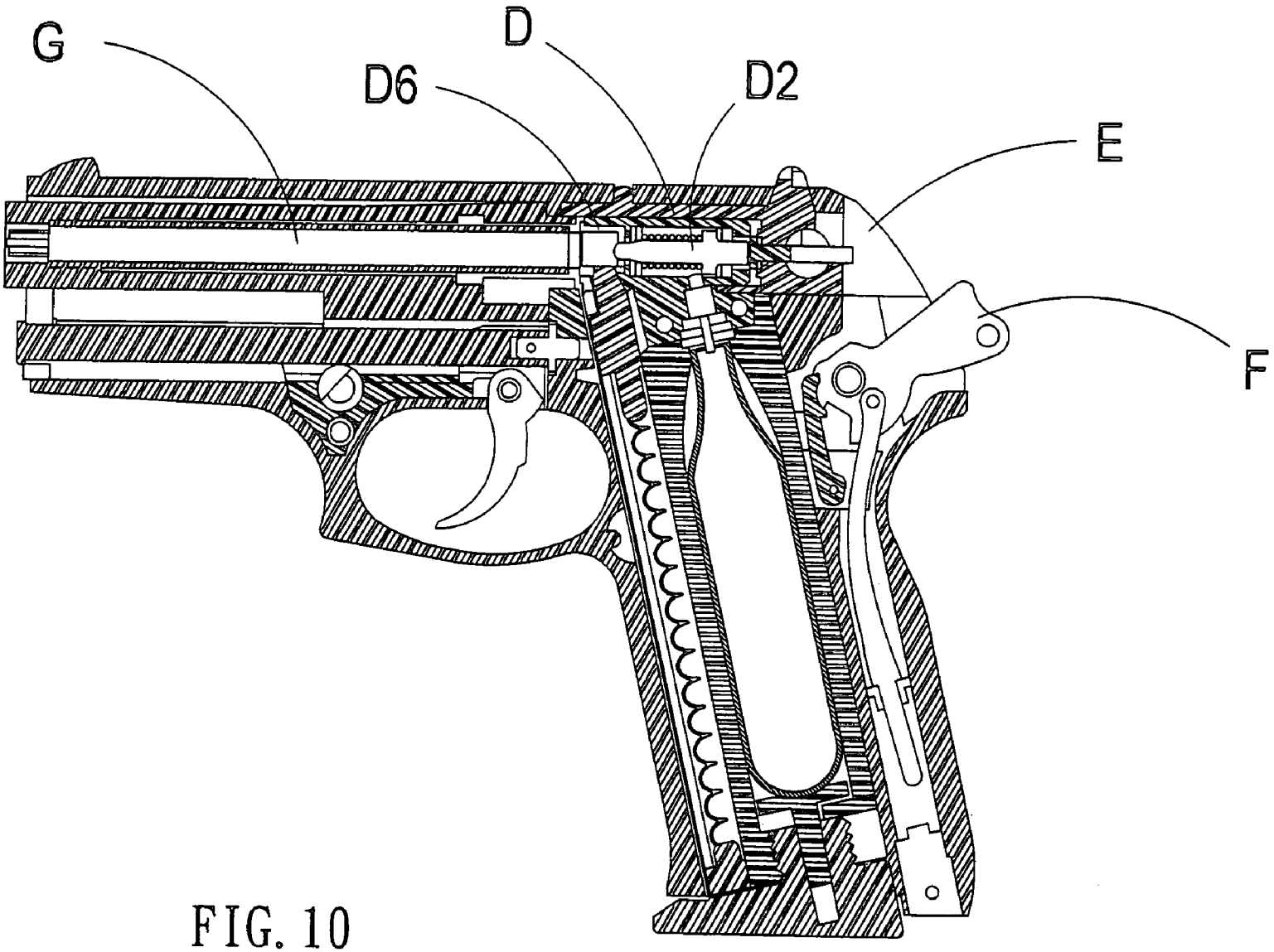
FIG. 10 shows a cross-sectional view of the embodiment according to the present invention in use (5).

Referring to FIGS. 9 and 10, when the piston rod D2 is driven forward by the pressurized gas, it simultaneously propels forward the pellets H within the securing ring D6 through a pistol barrel G.

When the piston rod D2 is driven forward by the pressurize gas, the gas cylinder D and the slide cover E are simultaneously driven backward, which thereby fixes the hammer F to a rear position, and achieves simplifying the mechanical movements involved in actuating the firing mechanism of a model pistol. Moreover, such a firing mechanism is provided with automatic operating functionality, and succeeds in simulating a real pistol.

In order to better explicitly disclose advancement and practicability of the present invention, a comparison with conventional art is described hereinafter:

Shortcomings of Conventional Art:

1. The majority of conventional model pistols adopt an internal hammer mechanism to propel the pellets.

2. A portion of conventional model pistols adopt an external connected high-pressure gas cylinder to propel the pellets.

3. Due to shortcomings 1 and 2, conventional model pistols are only able to realize an internal percussion action.

4. Due to shortcoming 3, simulation of realism is not achieved, which reduces use effectiveness.

5. Due to shortcoming 2, a user must carry a high-pressure gas cylinder.

6. Shortcoming 2 easily brings about a connecting tube used to connect the high-pressure gas cylinder to the model pistol affecting speed of the user when moving.

Advantages of the Present Invention:

1. The high-pressure gas cylinder is installed within the magazine, thereby eliminating the need for an extra connecting tune.

2. Pellet propulsion and backward movement of the slide cover E are simultaneously realized, thereby simplifying the mechanical process.

3. The slide cover E is automatically driven backward and actuates the hammer to fix it to a rear position, thereby providing the pistol with automatic operation functionality.

4. Due to the above advantages, functional processes are reduced and efficiency enhanced.

5. Due to the above advantages, mechanical movements involved in actuating the firing mechanism of a model pistol achieves simulating a real pistol.

6. Provided with practicability, advancement and facilitation.

7. Increases commercial competitiveness.

In conclusion, the present invention in overcoming structural shortcomings of prior art has assuredly achieved effectiveness of anticipated advancement, and, moreover, is easily understood by persons unfamiliar with related art. Furthermore, contents of the present invention have not been publicly disclosed prior to this application, and practicability and advancement of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A three-in-one high-pressure gas cylinder magazine assembly for a model pistol comprising:

a) a high-pressure gas cylinder; and b) a magazine removably inserted into a magazine cavity of the model pistol and having:

i) a cylinder having a valve, a piston rod, a spring, a securing washer and a plastic ring are configured therein;

ii) a holding cavity located below the cylinder, the high-pressure gas cylinder is removably inserted into the holding cavity of the magazine;

iii) a fine tuning knob and a securing cover located at a bottom portion of the holding cavity and selectively securing the high-pressure gas cylinder within the holding cavity;

iv) a pellet guide cavity located parallel to the holding cavity and holding at least one pellet; and v) a spring, a mount, and a securing seat located in the pellet guide cavity, the mount is connected to a first end of the spring and the securing seat is connected to a second end of the spring, the securing seat pressing the at least one pellet upwardly in the pellet guide cavity and securing the at least one pellet in the securing ring of the cylinder in a ready state for being propelled out of the model pistol, wherein, during a firing sequence of the model pistol, a gas from the high-pressure gas cylinder simultaneously driving the at least one pellet forward out of the model pistol and driving the cylinder and a slide cover of the model pistol rearwardly, the slide cover moving a hammer of the model pistol to a rearward position.

2. The three-in-one high-pressure gas cylinder magazine assembly according to claim 1, further comprising a holding cavity securing washer, a gas cylinder thimble, and a holding cavity plastic ring located at a top portion of the holding cavity.

* * * * *